US007508359B2

(12) United States Patent
Han

(10) Patent No.: US 7,508,359 B2
(45) Date of Patent: Mar. 24, 2009

(54) METHOD OF DRIVING A PLASMA DISPLAY PANEL

(75) Inventor: Jung Gwan Han, Gumi-si (KR)

(73) Assignee: LG Electronics Inc., Seoul (KR)

( * ) Notice: Subject to any disclaimer, the term of this patent is extended or adjusted under 35 U.S.C. 154(b) by 848 days.

(21) Appl. No.: 10/979,813

(22) Filed: Nov. 3, 2004

(65) Prior Publication Data

US 2005/0280607 A1 Dec. 22, 2005

(30) Foreign Application Priority Data

Nov. 3, 2003 (KR) ..... 10-2003-0077272

(51) Int. Cl.
*G09G 3/28* (2006.01)

(52) U.S. Cl. ..... 345/60; 345/66

(58) Field of Classification Search ..... 345/60, 345/66, 67, 68; 315/169.1, 169.3, 169.4
See application file for complete search history.

(56) References Cited

U.S. PATENT DOCUMENTS

| | | | | |
|---|---|---|---|---|
| 2001/0033256 | A1* | 10/2001 | Moore | 345/60 |
| 2002/0033675 | A1* | 3/2002 | Kang et al. | 315/169.1 |
| 2002/0167466 | A1* | 11/2002 | Setoguchi et al. | 345/60 |
| 2003/0080927 | A1* | 5/2003 | Sim et al. | 345/60 |
| 2004/0119665 | A1* | 6/2004 | Kang et al. | 345/63 |
| 2004/0251830 | A1* | 12/2004 | Nagao et al. | 313/582 |

FOREIGN PATENT DOCUMENTS

| | | | |
|---|---|---|---|
| EP | 1 020 838 | | 7/2000 |
| JP | 10207419 | | 8/1998 |
| JP | 11143423 | | 5/1999 |
| JP | 200267627 | | 9/2000 |
| KR | 20010091213 | A | 10/2001 |
| KR | 1020020019853 | A | 3/2002 |
| KR | 1020020061911 | A | 7/2002 |
| KR | 1020020066274 | A | 8/2002 |
| KR | 1020030021482 | | 3/2003 |
| KR | 1020040056047 | A | 6/2004 |
| KR | 10020040056010 | A | 6/2004 |
| KR | 1020040056422 | A | 7/2004 |

* cited by examiner

*Primary Examiner*—Amare Mengistu
*Assistant Examiner*—Hong Zhou
(74) *Attorney, Agent, or Firm*—McKenna Long & Aldridge LLP

(57) ABSTRACT

The present invention relates to a plasma display panel, and more particularly, to a method of driving a plasma display panel. According to an embodiment of the present invention, the method of driving the plasma display panel includes the step of: alternately applying a first sustain pulse to scan electrode lines and sustain electrode lines during a sustain period with a first period intervened between them; and applying the last sustain pulse to the scan electrode lines during the sustain period after a second period longer than the first period. Accordingly, more particularly, in low temperature environment, a stabilized address discharge can be generated in an address period of a subsequent selective erasing sub-field because a stable sustain discharge is generated by a last sustain pulse having a long pulse width.

12 Claims, 10 Drawing Sheets

METHOD OF DRIVING A PLASMA DISPLAY PANEL

This Nonprovisional application claims priority under 35 U.S.C. § 119(a) on Patent Application No. 10-2003-0077272 filed in Korea on Nov. 3, 2003, the entire contents of which are hereby incorporated by reference.

BACKGROUND OF THE INVENTION

1. Field of the Invention

The present invention relates to a plasma display panel, and more particularly, to a method of driving a plasma display panel.

2. Description of the Background Art

A plasma display panel (hereinafter, referred to as a 'PDP') is adapted to display an image including characters or graphics by light-emitting phosphors with ultraviolet of 147 nm generated during the discharge of a gas such as He+Xe, Ne+Xe or He+Ne+Xe. This PDP can be easily made thin and large, and it can provide greatly increased image quality with the recent development of the relevant technology. Particularly, a three-electrode AC surface discharge type PDP has advantages of lower driving voltage and longer product lifespan as a voltage necessary for discharging is lowered by wall charges accumulated on a surface upon discharging and electrodes are protected from sputtering caused by discharging.

FIG. 1 is a perspective view illustrating the construction of a discharge cell of a three-electrode AC surface discharge type PDP in a prior art.

Referring to FIG. 1, the discharge cell of the three-electrode AC surface discharge type PDP includes a scan electrode 30Y and a sustain electrode 30Z which are formed on the bottom surface of an upper substrate 10, and an address electrode 20X formed on a lower substrate 18.

The scan electrode 30Y includes a transparent electrode 12Y, and a metal bus electrode 13Y which has a line width smaller than that of the transparent electrode 12Y and is disposed at one edge side of the transparent electrode. The sustain electrode 30Z includes a transparent electrode 12Z, and a metal bus electrode 13Z which has a line width smaller than that of the transparent electrode 12Z and is disposed at one side edge of the transparent electrode. The transparent electrodes 12Y, 12Z, which are typically made of ITO (indium tin oxide), are formed on the bottom surface of the upper substrate 10. The metal bus electrodes 13Y, 13Z, which are typically made of chrome (Cr), are formed on the transparent electrodes 12Y, 12Z, and serve to reduce a voltage drop caused by the transparent electrodes 12Y, 12Z having high resistance. On the bottom surface of the upper substrate 10 in which the scan electrodes 30Y and the sustain electrodes 30Z are placed in parallel with each other are laminated an upper dielectric layer 14 and a protective layer 16. On the upper dielectric layer 14 are accumulated wall charges generated during plasma discharge. The protective layer 16 serves to protect the upper dielectric layer 14 from sputtering generated during the plasma discharge, and improve efficiency of secondary electron emission. Magnesium oxide (MgO) is typically used as the protective layer 16. The address electrodes 20X are formed in the direction in which they intersect the scan electrodes 30Y and the sustain electrodes 30Z. A lower dielectric layer 22 and barrier ribs 24 are formed on the lower substrate 18 in which the lower dielectric layer 22 is formed. The barrier ribs 24 are formed in parallel with the address electrodes 20X to physically divide the discharge cells, thus preventing ultraviolet and a visible ray generated by the discharge from leaking toward neighboring discharge cells. The phosphor layer 26 is excited with an ultraviolet generated during the plasma discharging to generate a visible light of any one of red, green and blue lights. An inert mixed gas such as He+Xe, Ne+Xe or He+Ne+Xe is injected into the discharge spaces of the discharge cells defined between the upper substrate 10 and the barrier ribs 24 and between the lower substrate 18 and the barrier ribs 24.

This three-electrode AC surface discharge type PDP is driven with one frame being divided into a plurality of sub-fields having a different number of emission in order to implement the gray scale of an image. Each of the sub fields is divided into a reset period for uniformly generating discharging, an address period for selecting a discharge cell, and a sustain period for implementing the gray level according to the number of discharging. If it is desired to display an image with 256 gray scales, a frame period (16.67 ms) corresponding to 1/60 seconds is divided into eight sub-fields SF1 to SF8, as shown in FIG. 2. Each of the sub-fields SF1 to SF8 is subdivided into a reset period, an address period and a sustain period. The reset period and the address period of each of the sub-fields SF1 to SF8 are the same every sub-field, whereas the sustain period and the frequency of its discharging number increase in the ratio of $2^n$ (where, n=0, 1, 2, 3, 4, 5, 6, 7) in each sub-field. As the sustain period becomes different in each sub-field as such, the gray scale of an image can be implemented.

A method of driving the PDP is mainly classified into a selective writing mode and a selective erasing mode depending on whether a discharge cell selected by an address discharge is light-emitted.

In the selective writing mode, the entire cells are turned off during the reset period, and on-cells to be turned on are selected during the address period. Further, in the selective writing mode, discharging of on-cells selected by an address discharge is maintained during the sustain period, so that an image is displayed.

In the selective erasing mode, the entire cells are turned on during the reset period, and off-cells to be turned off are selected during the address period. Moreover, in the selective erasing mode, discharging of on-cells except for the off-cells selected by the address discharge are maintained during the sustain period, so that an image is displayed.

The selective writing mode has an advantage in that the range of gray scale representation is wider than that of the selective erasing mode, but has a disadvantage in that an address period is longer than that of the selective erasing mode. On the contrary, the selective erasing mode has an advantage in that high-speed driving is possible, but has a disadvantage in that a contrast characteristic is worse than that of the selective writing mode since the entire cell are turned on during the reset period being a non-display period.

A so-called "SWSE mode", which has advantages better than those of the selective writing mode and the selective erasing mode, was disclosed in Korean Patent Application Nos. 10-2000-0012669, 10-2000-0053214, 10-2001-0003003, 10-2001-0006492, 10-2002-0082512, 10-2002-0082513, 10-2002-0082576 and so on, all of which were filed by the applicant of the present invention.

In this SWSE mode, one frame period includes a plurality of selective writing sub-fields in which on-cells are selected to display an image, and a plurality of selective erasing sub-fields in which off-cells are selected to display an image.

FIG. 3 shows a driving waveform of a PDP that is driven in the SWSE mode.

Referring to FIG. 3, one frame in a common SWSE mode includes a selective writing sub-field WSF having one or more sub-fields, and a selective erasing sub-field ESF having one or more sub-fields.

The selective writing sub-field WSF includes a m number (where, m is a positive integer greater than 0) of sub-fields SF1 to SFm. Each of the first to $(m-1)^{th}$ sub-fields SF1 to SFm−1 except for the $m^{th}$ sub-field SFm is divided into a reset period for uniformly forming a constant amount of wall charges in cells of the entire screen, a selective writing address period (hereinafter, referred to as 'writing address period') for selecting on-cells using a write discharge, a sustain period for causing a sustain discharge to occur in selected on-cells, and an erase period for erasing wall charges within cells after the sustain discharge. The $m^{th}$ sub-field SFm being the last sub-field of the selective writing sub-field WSF is divided into a reset period, a writing address period and a sustain period.

In the reset period of the selective writing sub-field WSF, a ramp waveform RPSU of a rising tilt in which a voltage rises up to a set-up voltage Vsetup is simultaneously applied to all the scan electrode lines Y. At the same time, a voltage of 0V or a ground voltage GND is applied to the sustain electrode lines Z and the address electrode lines X. The ramp-up waveform RPSU causes a dark discharge to occur between the scan electrode lines Y and the address electrode lines X and between the scan electrode lines Y and the sustain electrode lines Z within the cells of the entire screen. Wall charges of the positive (+) polarity are accumulated on the address electrode lines X and the sustain electrode lines Z and wall charges of the negative (−) polarity are accumulated on the scan electrode lines Y, by means of the set-up discharge.

After the ramp-up waveform RPSU, a ramp-down waveform RPSD of a falling tilt that starts to fall from a voltage of the positive polarity lower than the set-up voltage Vsetup is applied to the scan electrode lines Y. At the same time, a DC bias voltage Dcbias is applied to the sustain electrode lines Z. A dark discharge is generated between the scan electrode lines Y and the sustain electrode lines Z due to a voltage difference between the ramp-down waveform RPSD and the DC bias voltage DCbias. Further, a dark discharge is generated between the scan electrode lines Y and the address electrode lines X during a period where the ramp-down waveform RPSD drops. The set-down discharge by the ramp-down waveform RPSD erases excessive wall charges that do not contribute to the address discharge among charges generated by the ramp-up waveform RPSU. That is, the ramp-down waveform RPSD serves to set an initial condition of a stabilized write address.

In the writing address period of the selective writing sub-field WSF, a writing scan pulse SWSCN which drops up to a writing scan voltage −Vyw of the negative polarity is sequentially applied to the scan electrode lines Y, and at the same time a write data pulse SWD is applied to the address electrode lines X so that the writing scan pulse SWSCN is synchronized. While a voltage difference between the writing scan pulse SWSCN and the write data pulse SWD and a wall voltage that is accumulated previously within a cell are added, a write discharge is generated in on-cells to which the write data pulse SWD is applied. The write discharge causes wall charges of the positive polarity to be accumulated on the scan electrode lines Y and wall charges of the negative polarity to be accumulated on the sustain electrode lines Z and the address electrode lines X. The wall charges formed thus serve to lower an external voltage for generating the sustain discharge during the sustain period, i.e., a sustain voltage.

In the sustain period of the selective writing sub-field WSF, sustain pulses SUSPy, SUSPz are alternately supplied to the scan electrode lines Y and the sustain electrode lines Z. Whenever the sustain pulses SUSPy, SUSPz are applied as such, a sustain discharge is generated in on-cells in which a write discharge is generated during the writing address period. Meanwhile, in the last sub-field SFm of the selective writing sub-field WSF, the sustain pulse SUSPY having a width longer than that of the sustain pulses SUSPy, SUSPz that are supplied previously is supplied so that the last sustain discharge can be activated further.

After the last sustain discharge is generated, during the erase period of the first to $(m-1)^{th}$ sub-fields SF1 to SFm−1 except for the last sub-field SFm of the selective writing sub-field WSF, an erase ramp waveform ERS in which a voltage gradually rises up to a sustain voltage (Vs) is applied to the sustain electrode lines Z. The erase ramp waveform ERS causes the wall charges generated by the sustain discharge to be erased while generating a weak erase discharge in the on-cells. On the contrary, after the last sustain discharge is generated in the last sub-field SFm of the selective writing sub-field WSF, it is transferred to the first sub-field SFm+1 of the selective erasing sub-field ESF without any erase signal. Resultantly, the erase ramp waveform ERS or an erase voltage (or waveform) having this erase function is arranged in a corresponding sub-field only when a next sub-field is a selective writing sub-field.

The selective erasing sub-field ESF includes a n-m number (where, n is a positive integer greater than m) of sub-fields SFm+1 to SFn. Each of the $(m+1)^{th}$ to $n^{th}$ sub-fields SFm+1 to SFn is divided into a selective erase address period (hereinafter, referred to as 'erase address period') for selecting off-cells using an erase discharge, and a sustain period for generating a sustain discharge in on-cells.

In the address period of the selective erasing sub-field ESF, an erase scan pulse SESCN that falls up to an erase scan voltage −Vye of the negative polarity is applied to the scan electrode lines Y sequentially. At the same time, a selective erase data pulse SED that is synchronized with the erase scan pulse SESCN is applied to the address electrode lines X. As a voltage difference between the selective erase scan pulse SESCN of the negative polarity and the erase data pulse SED and a wall voltage in the on-cells that is maintained from a previous sub-field are added, an erase discharge is generated in the on-cells to which the selective erase data pulse SED is applied. The wall charges in the on-cells are erased by the erase discharge causes to the extent that a discharge is not generated though a sustain voltage is applied.

During the erase address period of the selective erasing sub-field ESF, a voltage of 0V or a ground voltage GND is applied to the sustain electrode lines Z.

In the sustain period of the selective erasing sub-field SEF, sustain pulses SUSPy, SUSPz are alternately applied to the scan electrode lines Y and the sustain electrode lines Z. Whenever the sustain pulses SUSPy, SUSPz are applied as such, a sustain discharge is generated in on-cells in which the erase discharge is not generated during the erase address period.

Meanwhile, the PDP that is driven in this SWSE mode is supplied with the sustain pulse SUSPY having a width longer than that of the sustain pulse SUSPy which is supplied previously so that the last sustain discharge is further activated in the last sub-field SFm of the selective writing sub-field WSF in order to form a sufficient wall charge in the first sub-field SFm+1 of the selective erasing sub-field ESF. In this time, in each of the sustain pulses SUSPy, SUSPz, SUSPY, after the sustain pulse SUSPy is provided to the scan electrode lines Y, the sustain pulse SUSPz is alternately supplied to the sustain electrode lines Z after a first period T1, as shown in FIG. 4 which shows in detail a portion "A" of FIG. 3. Thereafter, after the sustain pulse SUSPz is provided to the sustain electrode lines Z, the last sustain pulse SUSPY having a long pulse width is alternately supplied to the scan electrode lines Y after a second period T2. However, as the first period T1 and the second period T2 are approximately similarly set in a prior art, a strong sustain discharge is generated by the last sustain pulse SUSPY having the long pulse width. If the last sustain discharge is generated strongly as such, there is a problem in that a self-erasing discharge occurs when the last sustain pulse SUSPY provided to the scan electrode lines Y drops to the ground voltage GND. Accordingly, an address discharge may become difficult in the address period of a subsequent first selective erasing sub-field SFm+1.

This will now be described in detail. If the last sustain pulse SUSPz is supplied to the sustain electrode lines Z, wall charges of the positive (+) polarity are formed in the scan electrode lines Y and wall charges of the negative (−) polarity are formed in the sustain electrode lines Z, as shown in FIG. 5. Thereafter, the last sustain pulse SUSUY having a long pulse width is applied to the scan electrode lines Y, as shown in FIG. 4. A voltage value of the last sustain pulse SUSPY applied to the scan electrode lines Y causes a strong sustain discharge to occur together with a voltage value of the wall charges formed as shown in FIG. 5. In other words, as the width of the last sustain pulse SUSPY provided to the scan electrode lines Y is set widely, a strong sustain discharge occurs for a long time by means of the last sustain pulse SUSPY. If the strong sustain discharge is generated as such, a lot of wall charges of the negative (−) polarity are formed in the scan electrode lines Y and a lot of wall charges of the positive (+) polarity are also formed in the sustain electrode lines Z, as shown in FIG. 6.

Next, the last sustain pulse SUSPY applied to the scan electrode lines Y drops to the ground voltage GND. In this time, when the last sustain pulse SUSPY drops to the ground voltage GND, a self-erasing discharge is generated by lots of the wall charges formed in the scan electrode lines Y and the sustain electrode lines Z. In other words, the voltage value of lots of the wall charges of the negative (−) polarity which are formed in the scan electrode lines Y and the voltage value of lots of the wall charges of the positive (+) polarity which are formed in the sustain electrode lines Z in a prior art have a high voltage difference. Accordingly, when the ground voltage GND is applied to the scan electrode lines Y, a self-erasing discharge occurs. If the self-erasing discharge is generated as such, an unstable address discharge happens during the erase address period of a next selective erasing sub-field SFm+1 as the wall charges within the cells are erased as shown in FIG. 7. More particularly, this problem is further significant when a panel is driven at low temperature (approximately from −50□ to 10□).

SUMMARY OF THE INVENTION

Accordingly, an object of the present invention is to solve at least the problems and disadvantages of the background art.

An object of the present invention to provide a method of driving a PDP in which a discharge is generated stably.

According to an embodiment of the present invention, there is provided a method of driving a plasma display panel, including the step of alternately applying a first sustain pulse to scan electrode lines and sustain electrode lines during a sustain period with a first period intervened between them, wherein the last sustain pulse applied to the scan electrode lines during the sustain period is applied after a second period longer than the first period.

According to other embodiment of the present invention, there is provided a method of driving a plasma display panel in which one frame includes a plurality of selective writing sub-fields and a plurality of selective erasing sub-fields, including the steps of: alternately applying a first sustain pulse to scan electrode lines and sustain electrode lines during a sustain period with a first period intervened between them; and applying the last sustain pulse to the scan electrode lines during the sustain period after a second period longer than the first period.

In the method of driving the PDP according to embodiments of the present invention, the last sustain pulse having a long pulse width which is supplied to the scan electrode lines in the last selective writing sub-field is supplied after the sustain pulses are supplied. Accordingly, more particularly in low temperature environment, a stable sustain discharge is generated by the last sustain pulse having the long pulse width is generated and a stabilized address discharge is thus generated in the address period of a subsequent selective erasing sub-field.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

According to an embodiment of the present invention, there is provided a method of driving a plasma display panel, including the step of alternately applying a first sustain pulse to scan electrode lines and sustain electrode lines during a sustain period with a first period intervened between them, wherein the last sustain pulse applied to the scan electrode lines during the sustain period is applied after a second period longer than the first period.

The first period is set to be approximately less than 3 μs and the second period is set to be approximately 3 μs or more.

A width of the last sustain pulse is set to be longer than that of the first sustain pulse.

The last sustain pulse is applied to the scan electrode lines after the second period when the panel is driven at low temperature.

The low temperature ranges from −50□ to 10□.

According to other embodiment of the present invention, there is provided a method of driving a plasma display panel in which one frame includes a plurality of selective writing sub-fields and a plurality of selective erasing sub-fields, including the steps of: alternately applying a first sustain pulse to scan electrode lines and sustain electrode lines during a sustain period with a first period intervened between them; and applying the last sustain pulse to the scan electrode lines during the sustain period after a second period longer than the first period.

The last sustain pulse is applied to the scan electrode lines after the second period when the panel is driven at low temperature.

The low temperature ranges from −50□ to 10□.

The at least one selective writing sub-field is a sub-field that is located immediately before the selective erasing sub-field.

The at least one selective writing sub-field is a sub-field having 32 brightness weight.

The first period is set to be approximately less than 3 μs and the second period is set to be approximately 3 μs or more.

A width of the last sustain pulse is set to be longer than that of the first sustain pulse.

Hereinafter, the embodiments of the present invention will be described with drawings.

Figure 1:
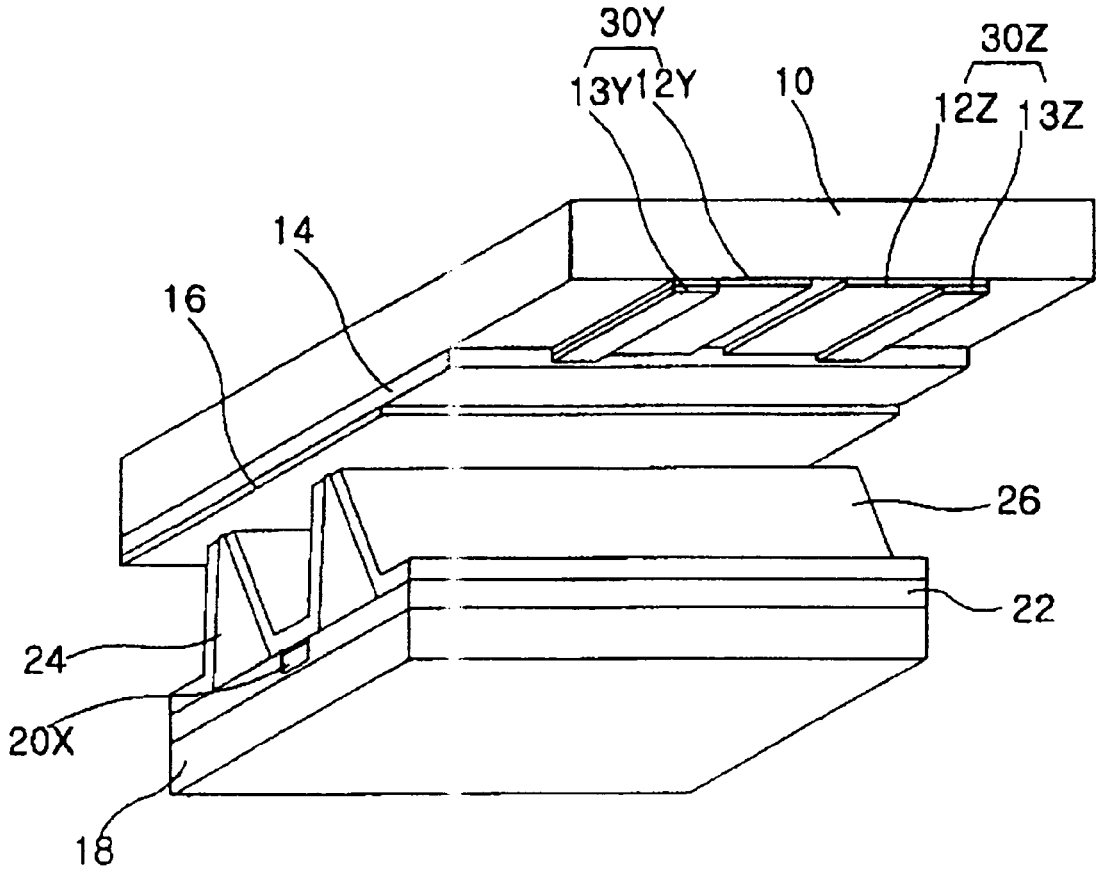
FIG. 1 is a perspective view illustrating the construction of a discharge cell of a three-electrode AC surface discharge type PDP in a prior art.
Figure 2:
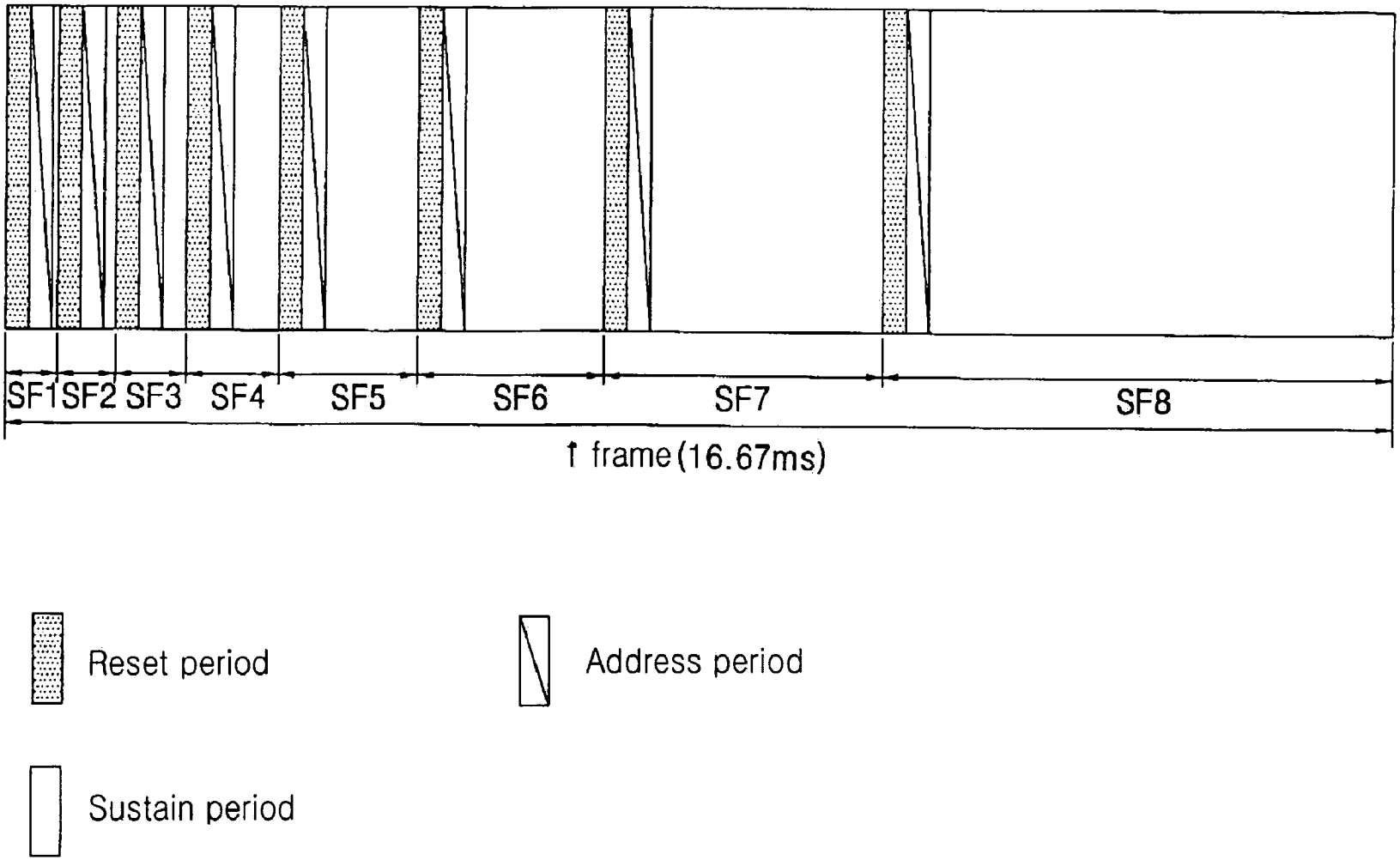
FIG. 2 shows a sub-field pattern of a frame period in a driving method of a PDP in a prior art.
Figure 3:
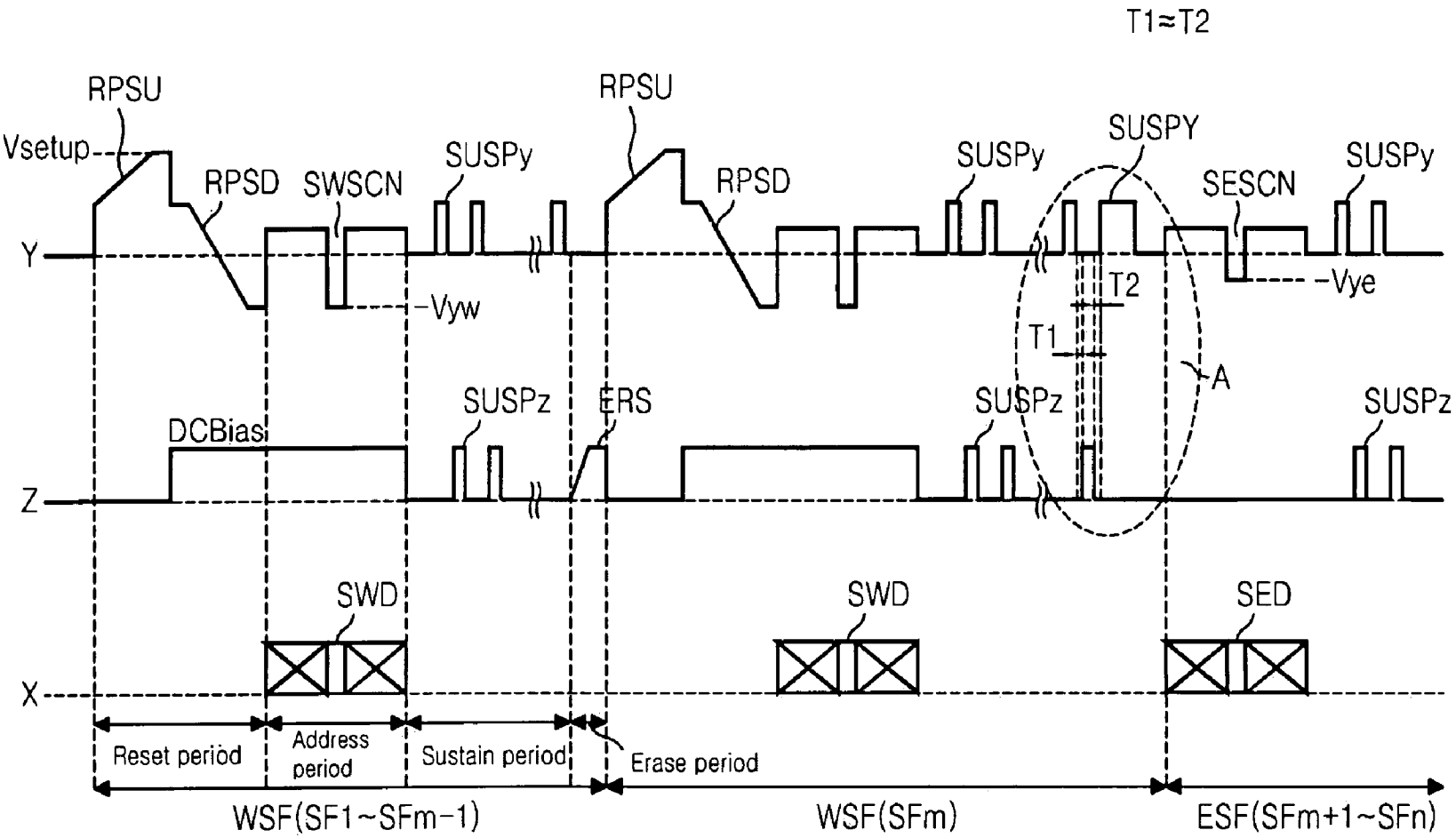
FIG. 3 shows a driving waveform of a PDP that is driven in the SWSE mode in a prior art.
Figure 4:
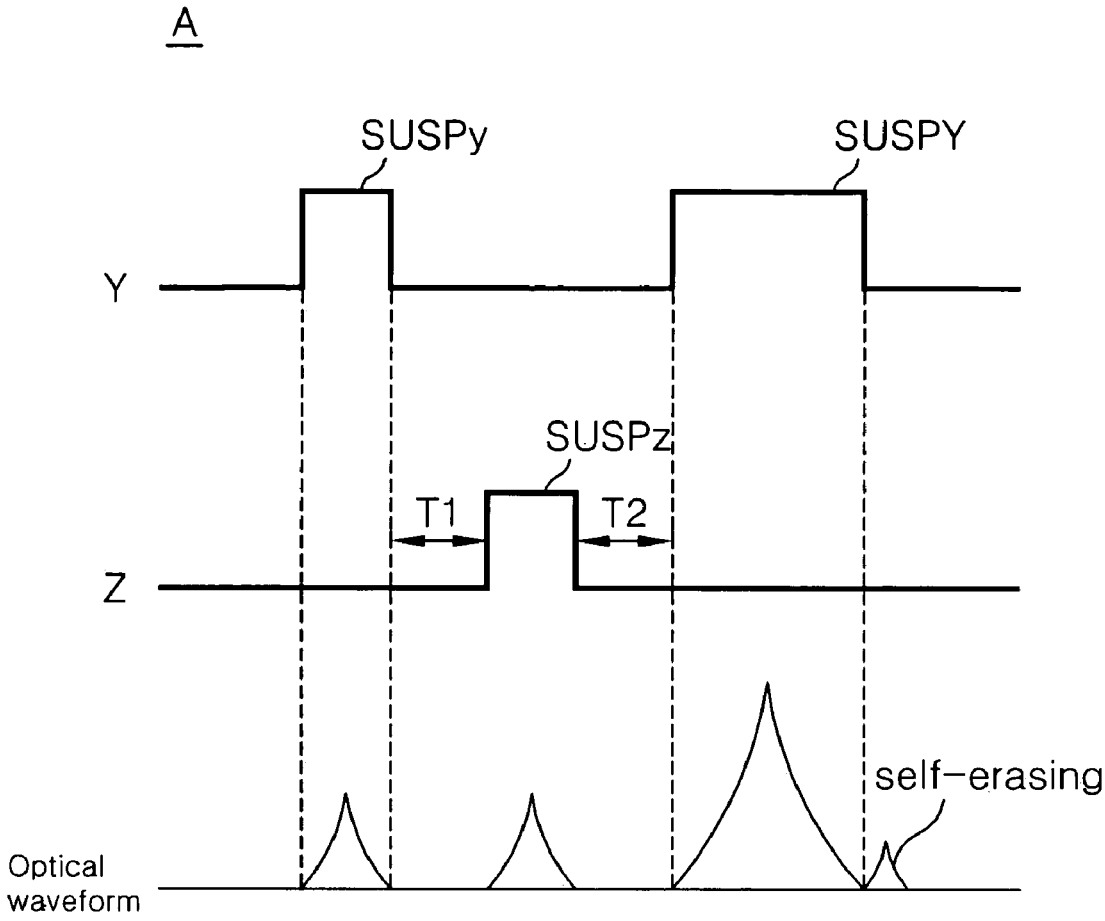
FIG. 4 is a detailed view of a portion "A" in the driving waveform of the PDP shown in FIG. 3.
Figure 5:
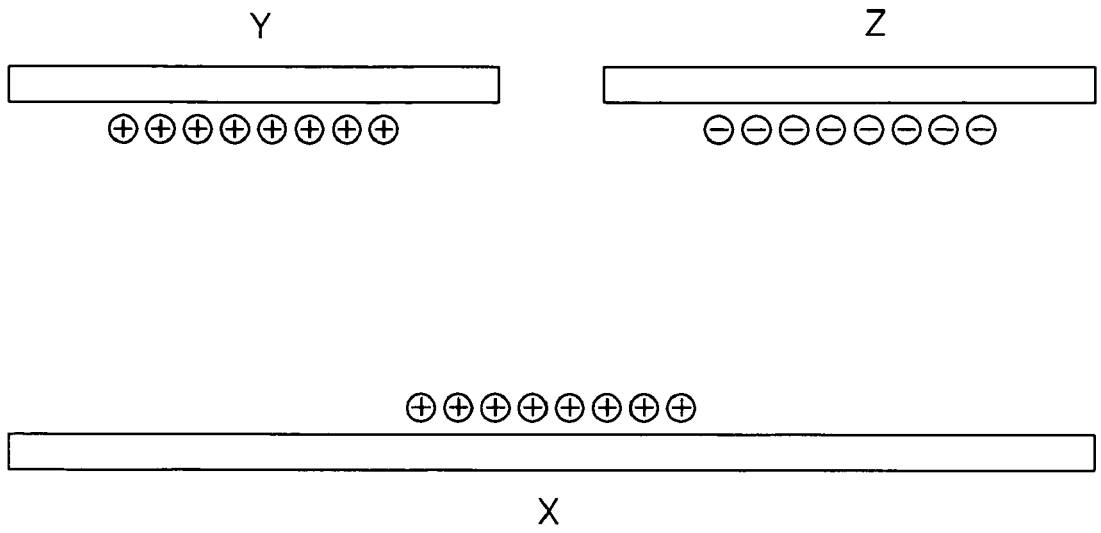
FIG. 5 shows wall charges formed by the last sustain pulse that is applied to the sustain electrode lines.
Figure 6:
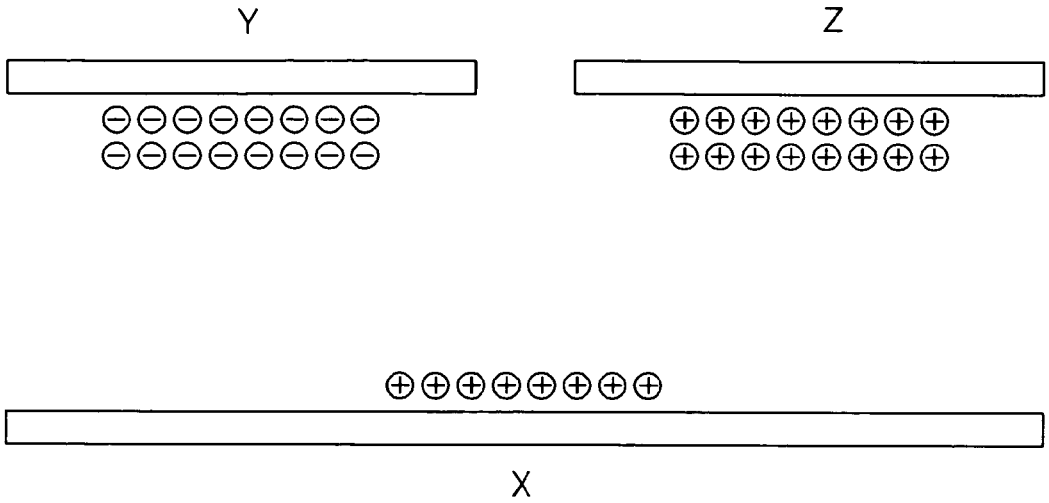
FIG. 6 shows wall charges formed by the last sustain pulse that is applied to the scan electrode lines.
Figure 7:
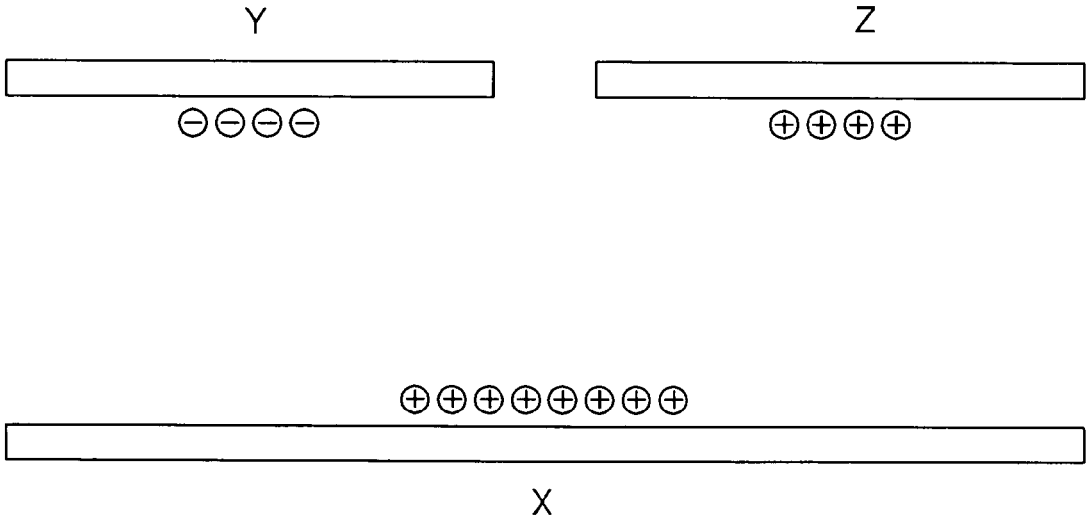
FIG. 7 shows that wall charges formed by the last sustain pulse applied to the scan electrode lines are erased by self-erasing.
Figure 8:
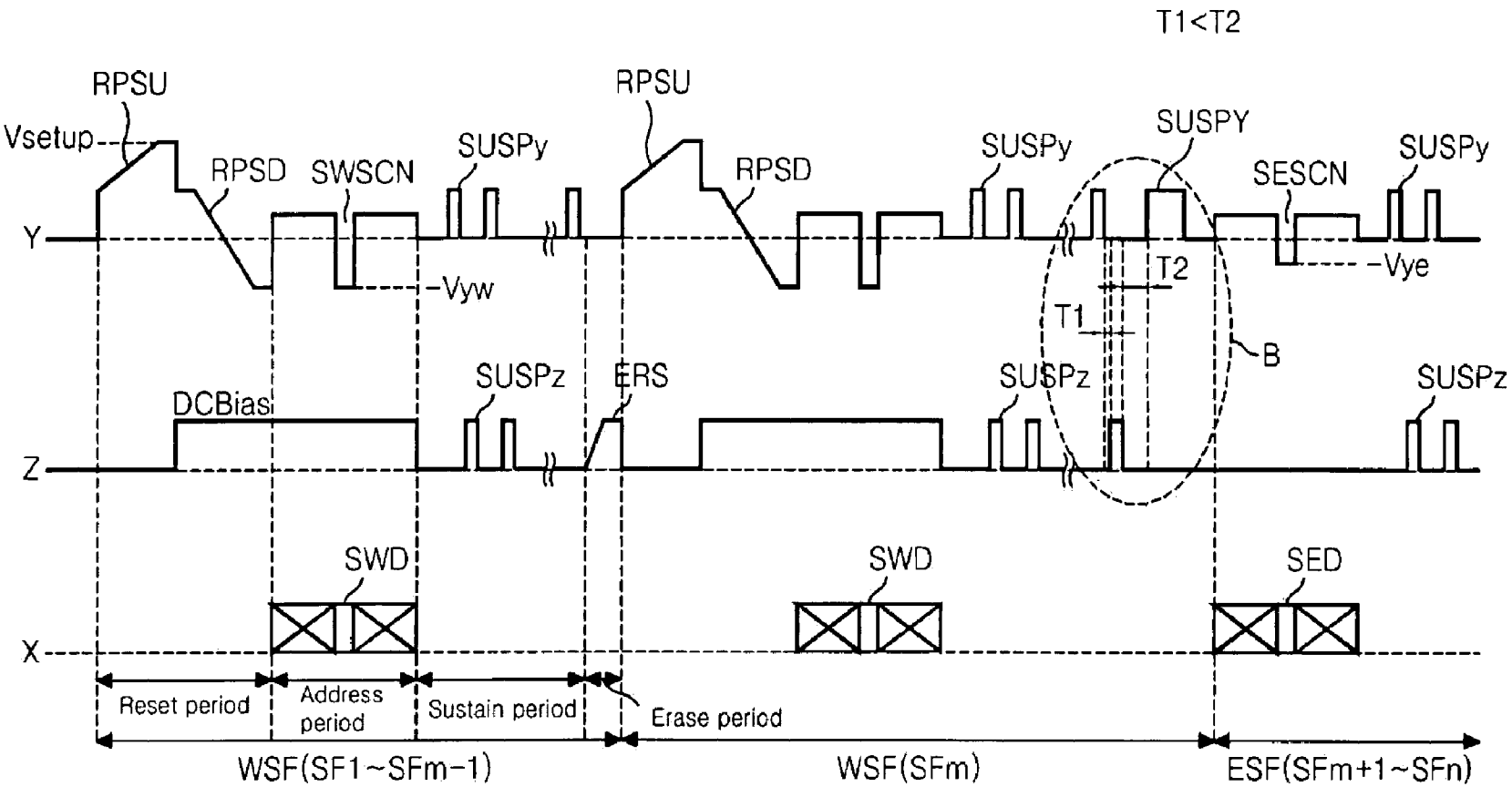
FIG. 8 shows a driving waveform of a plasma display panel according to an embodiment of the present invention.

FIG. 8 shows a driving waveform of a plasma display panel according to an embodiment of the present invention.

Referring to FIG. 8, in a driving waveform of the PDP according to an embodiment of the present invention, one frame includes a selective writing sub-field WSF having one or more sub-fields, and a selective erasing sub-field ESF having one or more sub-fields.

The selective writing sub-field WSF includes a m number (where, m is a positive integer greater than 0) of sub-fields SF1 to SFm. Each of the first to $(m-1)^{th}$ sub-fields SF1 to SFm−1 except for the $m^{th}$ sub-field SFm is divided into a reset period for uniformly forming a constant amount of wall charges in cells of the entire screen, a selective writing address period for selecting on-cells using a write discharge, a sustain period for causing a sustain discharge to be generated in selected on-cells, and an erase period for erasing wall charges within cells after the sustain discharge. The $m^{th}$ sub-field SFm being the last sub-field of the selective writing sub-field WSF is divided into a reset period, a writing address period and a sustain period.

In the reset period of the selective writing sub-field WSF, a ramp waveform RPSU of a rising tilt that rises up to a set-up voltage Vsetup is applied to all the scan electrode lines Y simultaneously. At the same time, a voltage of 0V or a ground voltage GND is applied to the sustain electrode lines Z and the address electrode lines X. The ramp-up waveform RPSU causes a dark discharge to be generated between the scan electrode lines Y and the address electrode lines X and between the scan electrode lines Y and the sustain electrode lines Z within the cells of the entire screen. Wall charges of the positive (+) polarity are accumulated on the address electrode lines X and the sustain electrode lines Z and wall charges of the negative (−) polarity are accumulated on the scan electrode lines Y, by means of the set-up discharge. After the ramp-up waveform RPSU, a ramp-down waveform RPSD of a falling tilt that starts to fall from a voltage of the positive polarity that is lower than the set-up voltage Vsetup is applied to the scan electrode lines Y. At the same time, a DC bias voltage Dcbias is applied to the sustain electrode lines Z. A dark discharge is generated between the scan electrode lines Y and the sustain electrode lines Z due to a voltage difference between the ramp-down waveform RPSD and the DC bias voltage DCbias. A dark discharge is also generated between the scan electrode lines Y and the address electrode lines X during a period where the ramp-down waveform RPSD drops. The set-down discharge by the ramp-down waveform RPSD serves to erase excessive wall charges that do not contribute to the address discharge among the charges generated by the ramp-up waveform RPSU. That is, the ramp-down waveform RPSD serves to set an initial condition of a stabilized write address.

In the writing address period of the selective writing sub-field WSF, a writing scan pulse SWSCN that drops up to a writing scan voltage −Vyw of the negative polarity is sequentially applied to the scan electrode lines Y. At the same time, a write data pulse SWD is applied to the address electrode lines X so that the writing scan pulse SWSCN is synchronized. As a voltage difference between the writing scan pulse SWSCN and the write data pulse SWD and a wall voltage accumulated previously within cells are added, a write discharge is generated in on-cells to which the write data pulse SWD is applied. The write discharge causes wall charges of the positive polarity to be accumulated on the scan electrode lines Y and wall charges of the negative polarity to be accumulated on the sustain electrode lines Z and the address electrode lines X. The wall charges formed thus serve to lower an external voltage for generating the sustain discharge during the sustain period, i.e., a sustain voltage.

Figure 9:
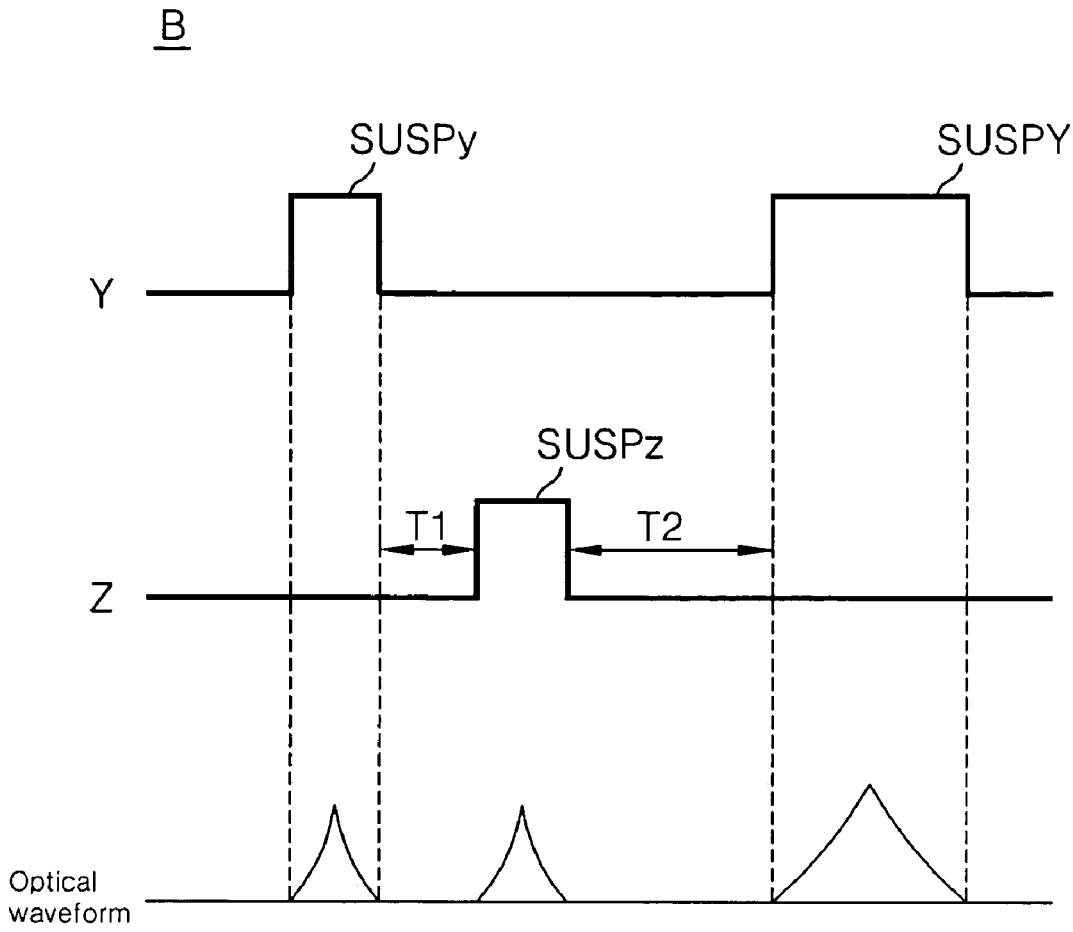
FIG. 9 is a detailed view of a portion "B" in the driving waveform of the PDP shown in FIG. 8.

In the sustain period of the selective writing sub-field WSF, sustain pulses SUSPy, SUSPz are alternately supplied to the scan electrode lines Y and the sustain electrode lines Z. Whenever the sustain pulses SUSPy, SUSPz are applied as such, a sustain discharge is generated in on-cells in which a write discharge is generated during the writing address period. These sustain pulses SUSPy, SUSPz are alternately provided to the scan electrode lines Y and the sustain electrode lines Z with a distance of a first period T1 intervened between them. Meanwhile, in the last sub-field SFm of the selective writing sub-field WSF, a sustain pulse SUSPY having a width longer than that of the sustain pulses SUSPy, SUSPz that are supplied so far so that the last sustain discharge is further activated. This last sustain pulse SUSPY is alternately supplied to the scan electrode lines Y after a second period T2 that is set to be longer than the first period T1 after the last sustain pulse SUSPz is applied to the sustain electrode lines Z, as shown in FIG. 9 which is a detailed views of a portion "B" in FIG. 8. In this time, the first period T1 is set to be approximately less than 3 μs and the second period T2 is set to be approximately 3 μs or more. Accordingly, as a discharge is not generated largely by the last sustain pulse SUSPY supplied to the scan electrode lines Y, a stable address discharge can be generated in an address period of a subsequent first selective erasing sub-field SFm+1.

Figure 10:
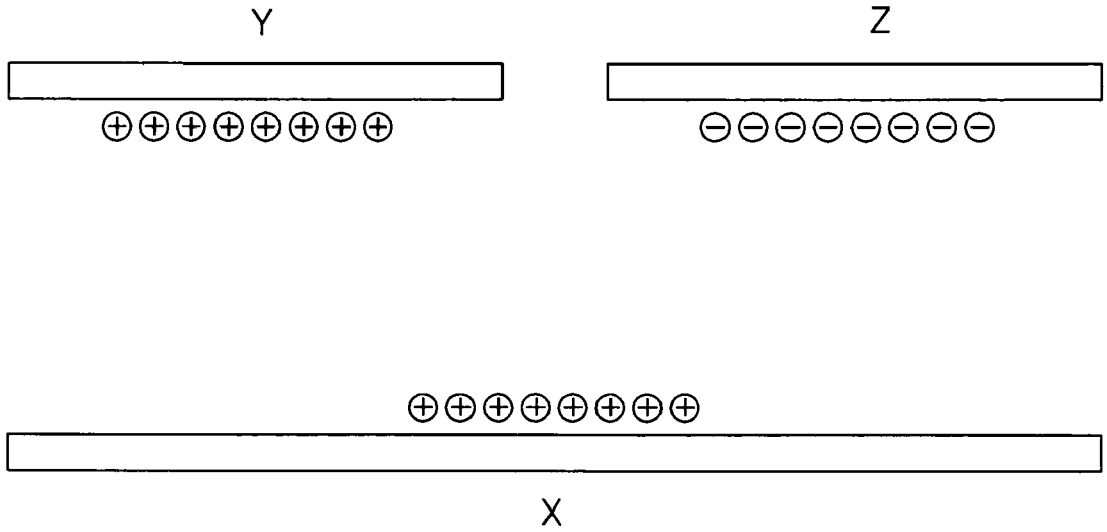
FIG. 10 shows wall charges formed by the last sustain pulse that is applied to the sustain electrode lines.
Figure 11:
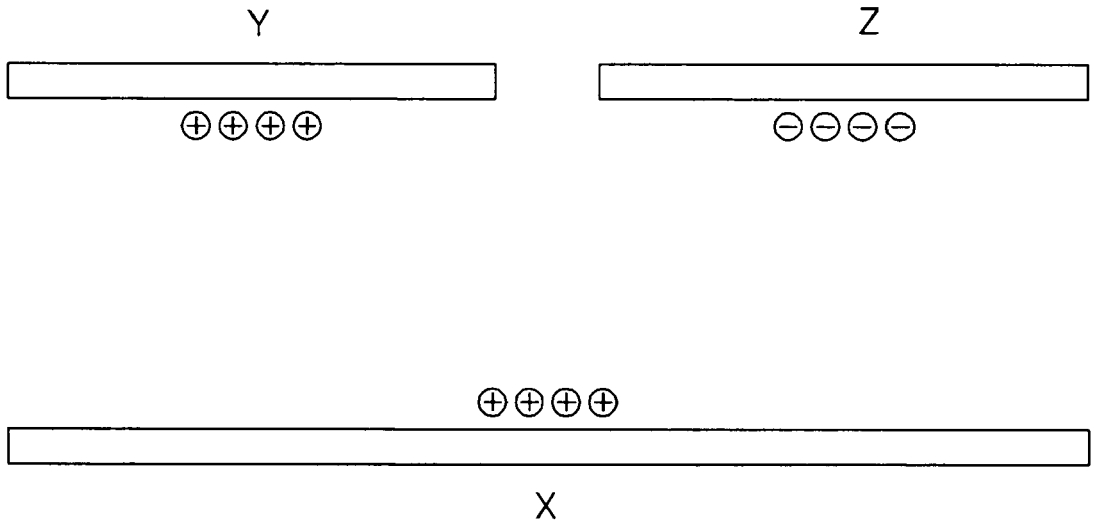
FIG. 11 shows a decrease in the number of wall charges formed by the last sustain pulse that is applied to the sustain electrode lines, through recombination of the wall charges.
Figure 12:
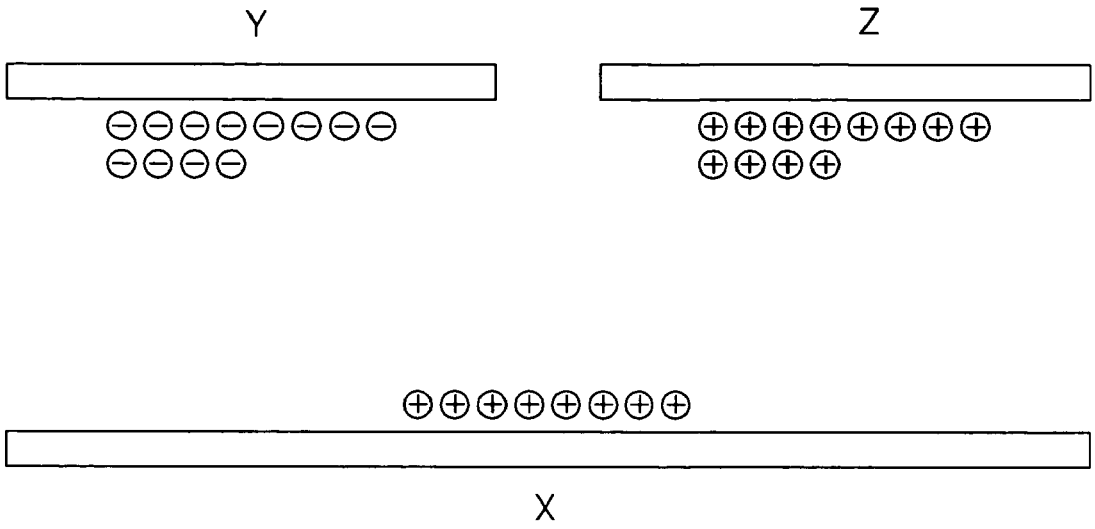
FIG. 12 shows wall charges formed by the last sustain pulse that is applied to the scan electrode lines.

This will be described in detail as follows. If the last sustain pulse SUSPz is supplied to the sustain electrode lines Z, wall charges of the positive (+) polarity are formed in the scan electrode lines Y and wall charges of the negative (−) polarity are formed in the sustain electrode lines Z, as shown in FIG. 10. Thereafter, the last sustain pulse SUSPY having the long pulse width is supplied to the scan electrode lines Y after the second period T2 that is longer than the first period T1, as shown in FIG. 9. Accordingly, the wall charges as shown in FIG. 10, which are formed by the last sustain pulse SUSPz supplied to the sustain electrode lines Z, are recombined sufficiently during the second period T2. As a result, the number of the wall charges is reduced, as shown in FIG. 11. Therefore, a voltage value of the last sustain pulse SUSPY applied to the scan electrode lines Y causes a stabilized sustain discharge to occur together with a voltage value of the wall charges formed as shown in FIG. 11. If this stabilized sustain discharge is generated, sufficient wall charges of the negative (−) polarity are formed in the scan electrode lines Y and sufficient wall charges of the positive (+) polarity are also formed in the sustain electrode lines Z, as shown in FIG. 12.

Thereafter, the last sustain pulse SUSPY applied to the scan electrode lines Y falls to the ground voltage GND. In this time, although the last sustain pulse SUSPY falls to the ground voltage GND, an appropriate amount of wall charges is formed in the scan electrode lines Y and the sustain electrode lines Z. It is thus possible to prevent a self-erasing discharge from occurring. Accordingly, as sufficient wall charges are formed in the last sustain pulse SUSPY applied to the scan electrode lines Y, a stabilized address discharge can be generated in an address period of a subsequent first selective erasing sub-field SFm+1.

After the last sustain discharge is generated, during the erase period of the first to $(m-1)^{th}$ sub-fields SF1 to SFm−1 of the selective writing sub-field WSF except for the last sub-field SFm, an erase ramp waveform ERS in which a voltage gradually rises up to the sustain voltage (Vs) is applied to the sustain electrode lines Z. The wall charges generated by the sustain discharge are erased by the erase ramp waveform ERS, while a weak erase discharge is generated in the on-cells. On the contrary, after the last sustain discharge is generated in the last sub-field SFm of the selective writing sub-field WSF, it is transferred to the first sub-field SFm+1 of the selective erasing sub-field ESF without any erase signal. Resultantly, the erase ramp waveform ERS or an erase voltage (or waveform) having this erase function is arranged in a corresponding sub-field only when a next sub-field is a selective writing sub-field.

The selective erasing sub-field ESF includes an n-m number (where, n is a positive integer greater than m) of sub-fields SFm+1 to SFn. Each of the $(m+1)^{th}$ to $n^{th}$ sub-fields SFm+1 to SFn is divided into an erase address period for selecting off-cells using an erase discharge, and a sustain period for generating a sustain discharge in on-cells.

In the address period of the selective erasing sub-field ESF, an erase writing scan pulse SESCN that drops up to an erase scan voltage −Vye of the negative polarity is sequentially applied to the scan electrode lines Y. At the same time, an erase data pulse SED synchronized with the erase scan pulse SESCN is applied to the address electrode lines X. As a voltage difference between the selective erase scan pulse SESCN of the negative polarity and the selective erase data pulse SWD and a wall voltage of on-cells which is kept from a previous sub-field are added, an erase discharge is generated in on-cells to which the selective erase data pulse SED is applied. The wall charges within the on-cells are erased by the erase discharge to the extent that a discharge is not generated although the sustain voltage is applied.

In the address period of the selective erasing sub-field SEF, a voltage of 0V or a ground voltage GND is applied to the sustain electrode lines Z.

In the sustain period of the selective erasing sub-field SEF, sustain pulses SUSPy, SUSPz are alternately applied to the scan electrode lines Y and the sustain electrode lines Z. Every when the sustain pulses SUSPy, SUSPz are applied as such, a sustain discharge is generated in on-cells in which an erase discharge is not generated in the erase address period.

Meanwhile, a data coding method for address in the driving method of the PDP that is driven in the SWSE mode will now be described. If it is assumed that one frame is composed of six selective writing sub-fields SF1 to SF6 whose brightness relative ratios are differently set to $2^0$, $2^1$, $2^2$, $2^3$, $2^4$ and $2^5$, respectively, and six selective erasing sub-fields SF7 to SF12 whose brightness relative ratios are set to $2^5$, the level of the gray scale that is represented by a combination of the sub-fields SF1 to SFn and a coding method can be expressed into the following Table 1.

TABLE 1

| Gray Scale | SF1 (1) | SF2 (2) | SF3 (4) | SF4 (8) | SF5 (16) | SF6 (32) | SF7 (32) | SF8 (32) | SF9 (32) | SF10 (32) | SF11 (32) | SF12 (32) |
|---|---|---|---|---|---|---|---|---|---|---|---|---|
| 0□31 | | | Binary coding | | | x | x | x | x | x | x | x |
| 32□63 | | | Binary coding | | | o | x | x | x | x | x | x |
| 64□95 | | | Binary coding | | | o | o | x | x | x | x | x |
| 96□127 | | | Binary coding | | | o | o | o | x | x | x | x |
| 128□159 | | | Binary coding | | | o | o | o | o | x | x | x |
| 160□191 | | | Binary coding | | | o | o | o | o | o | x | x |
| 192□223 | | | Binary coding | | | o | o | o | o | o | o | x |
| 224□255 | | | Binary coding | | | o | o | o | o | o | o | o |

As can be seen from Table 1, the first to fifth sub-fields SF1 to SF5 disposed in front of the frame represent gray scale values of cells through binary coding. Further, the sixth to twelfth sub-fields SF6 to SF12 decide brightness of the cells through linear coding over a predetermined gray scale value and thus represent gray scale values of the cells. In this time, it was experimentally found that the giving waveform of the PDP driven in the SWSE mode according to an embodiment of the present invention is better applied when the sixth sub-field SF6 being the last selective writing sub-field which goes over from the selective writing sub-field to the selective erasing sub-field has 32 brightness weight.

In the method of driving the PDP according to an embodiment of the present invention, the last sustain pulse SUSPY having the long pulse width is supplied to the scan electrode lines Y after the second period T2 set to be longer than the first period T1 after the last sustain pulse SUSPz is supplied to the sustain electrode lines Z. Accordingly, even when the sustain discharge is generated by the last sustain pulse SUSPz applied to the sustain electrode lines Z, its influence can be minimized since the last sustain pulse SUSPY is applied to the scan electrode lines Y after the second period T2 that is set to be longer than the first period T1. Accordingly, more particularly, in low temperature environment, a stabilized address discharge can be generated in an address period of a subsequent selective erasing sub-field because a stable sustain discharge is generated by a last sustain pulse having a long pulse width.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of driving a plasma display panel, comprising the step of:

alternately applying a first sustain pulse to scan electrode lines and sustain electrode lines during a sustain period with a first period which is an interval between the first sustain pulse applied to the scan electrode lines and the first sustain pulse applied to the sustain electrode lines; and applying the last sustain pulse to the scan electrode lines during the sustain period after a second period longer than the first period, wherein the second period is an interval between the last sustain pulse applied to the scan electrode lines and the first sustain pulse applied to the sustain electrode lines for the last time.

2. The method as claimed in claim 1, wherein the first period is set to be less than 3 μs and the second period is set to be 3 μs or more.

3. The method as claimed in claim 1, wherein a width of the last sustain pulse is set to be longer than that of the first sustain pulse.

4. The method as claimed in claim 1, wherein the last sustain pulse is applied to scan electrode lines after the second period when the panel is driven at low temperature.

5. The method as claimed in claim 4, wherein the low temperature ranges from −50° C. to 10° C.

6. A method of driving a plasma display panel in which one frame includes a plurality of selective writing sub-fields and a plurality of selective erasing sub-fields, comprising the steps of:

alternately applying a first sustain pulse to the scan electrode lines and the sustain electrode lines with a first period which is an interval between the first sustain pulse applied to the scan electrode lines and the first sustain pulse applied to the sustain electrode lines during a sustain period of at least one selective writing sub-field among the plurality of the selective writing sub-fields; and applying the last sustain pulse to the scan electrode lines after a second period longer than the first period, wherein the second period is an interval between the last sustain pulse applied to the scan electrode lines and the first sustain pulse applied to the sustain electrode lines for the last time.

7. The method as claimed in claim 6, wherein the last sustain pulse is applied to the scan electrode lines after the second period when the panel is driven at low temperature.

8. The method as claimed in claim 7, wherein the low temperature ranges from −50° C. to 10° C.

9. The method as claimed in claim 6, wherein the at least one selective writing sub-field is a sub-field that is located immediately before the selective erasing sub-field.

10. The method as claimed in claim 9, wherein the at least one selective writing sub-field is a sub-field having a brightness weight of 32.

11. The method as claimed in claim 6, wherein the first period is set to be less than 3 μs and the second period is set to be 3 μs or more.

12. The method as claimed in claim 6, wherein a width of the last sustain pulse is set to be longer than that of the first sustain pulse.

* * * * *